US007743761B2

(12) United States Patent
Mercord et al.

(10) Patent No.: US 7,743,761 B2
(45) Date of Patent: Jun. 29, 2010

(54) ROCK CUTTING AND TRIMMING DEVICE

(75) Inventors: Bradley C. Mercord, Kalispell, MT (US); Irvin M. Wenzel, Kalispell, MT (US); Mark James Halbur, Kalispell, MT (US)

(73) Assignee: Brill Investments, LLC, Kalispell, MT (US)

( * ) Notice: Subject to any disclaimer, the term of this patent is extended or adjusted under 35 U.S.C. 154(b) by 0 days.

(21) Appl. No.: 12/195,381

(22) Filed: Aug. 20, 2008

(65) Prior Publication Data

US 2010/0043770 A1 Feb. 25, 2010

(51) Int. Cl.
*B28D 1/26* (2006.01)

(52) U.S. Cl. ..... 125/23.01; 125/40

(58) Field of Classification Search ..... 125/23.01, 125/40, 41

See application file for complete search history.

(56) References Cited

U.S. PATENT DOCUMENTS

| | | | | | |
|---|---|---|---|---|---|
| 205,989 | A | * | 7/1878 | Andrews | 125/23.01 |
| 254,415 | A | * | 2/1882 | Wellington | 125/23.01 |
| 1,353,367 | A | * | 9/1920 | Whipple | 83/549 |
| 1,736,041 | A | | 11/1929 | Huff | |
| 1,774,328 | A | | 8/1930 | Huff | |
| 2,224,708 | A | | 12/1940 | Van Sittert | |
| 3,998,201 | A | * | 12/1976 | Miura et al. | 125/23.01 |
| 4,880,335 | A | * | 11/1989 | Lee | 405/158 |
| 4,932,128 | A | | 6/1990 | Dacey, Jr. | |
| 4,932,597 | A | * | 6/1990 | Bieri | 241/266 |
| 4,947,672 | A | | 8/1990 | Pecora et al. | |
| 5,070,616 | A | | 12/1991 | Chen | |
| 5,465,490 | A | | 11/1995 | Smith et al. | |
| 6,745,611 | B2 | | 6/2004 | Lefavour et al. | |
| 6,928,739 | B2 | | 8/2005 | Jirele et al. | |
| 6,957,560 | B2 | | 10/2005 | Lefavour et al. | |
| 7,111,488 | B2 | | 9/2006 | Lefavour et al. | |
| 7,165,439 | B2 | | 1/2007 | Lefavour et al. | |
| 2004/0255470 | A1 | | 12/2004 | Jirele et al. | |
| 2008/0196706 | A1 | * | 8/2008 | Fowler | 125/23.01 |

* cited by examiner

*Primary Examiner*—Robert Rose
(74) *Attorney, Agent, or Firm*—Antoinette M. Tease

(57) ABSTRACT

A rock cutting and trimming device comprising a C-clamp, a hydraulic cylinder, a sleeve, a shaft, a top tooth, and a bottom tooth. The hydraulic cylinder is coupled to the shaft, the shaft fits inside of the sleeve, the sleeve is coupled to the top port of the C-clamp, the top tooth is coupled to the shaft, and the bottom tooth is coupled to the bottom port of the C-clamp. Each of the top and bottom teeth comprises a cutting edge, the cutting edge of the top tooth faces the cutting edge of the bottom tooth, the hydraulic cylinder causes the top tooth to move vertically upward and downward, and the cutting edges of the top and bottom teeth are vertically aligned so that when the top tooth is fully extended downward, the cutting edge of the top tooth is parallel to the cutting edge of the bottom tooth.

6 Claims, 11 Drawing Sheets

ROCK CUTTING AND TRIMMING DEVICE

BACKGROUND OF THE INVENTION

1. Field of the Invention

The present invention relates to a hydraulically operated device for cutting or trimming rock, including corner pieces.

2. Description of the Related Art

Rock slitters or cutters currently on the market include the HYDRASPLIT® stone splitter manufactured by Park Industries of St. Cloud, Minn. The HYDRASPLIT® stone splitters come in various models and are hydraulically operated. These splitters all incorporate a tabletop design that makes it virtually impossible to cut corner pieces with any degree of precision.

Cee-Jay Tool Company, Inc. of Loveland, Colo. manufactures and sells both a stationary and a portable version of a hydraulically operated stone cutter called the STONE MASON™. Like the HYDRASPLIT™, the STONE MASON™ has a tabletop-type configuration that makes it difficult to cut corner pieces.

E&R Manufacturing Company Inc. of Kirklin, Ind. manufactures and sells the ELMER'S MIDGET HELPER™, which is a manually operated rock cutter. Although the ELMER'S MIDGET HELPER™ appears to be open enough in its design that it could accommodate corner pieces, it is simply not as powerful as a hydraulically operated cutter. The same company makes the ELMER'S LITTLE HELPER™, which incorporates a tabletop design with side pillars and therefore cannot be used effectively with corner pieces.

Not only does the present invention cut corner pieces with precision, but it is hydraulically operated and designed to withstand the forces associated with up to 25 tons of hydraulic pressure. Specifically, the present invention incorporates an open C-clamp design that allows greater flexibility than any prior art device in terms of manipulating the rock piece.

There are various patented cutting, piercing or splitting devices that utilize C-clamp-type designs, but none that incorporates the rock cutting features of the present invention. These patents include U.S. Pat. No. 1,736,041 (Huff, 1929); U.S. Pat. No. 1,774,328 (Huff, 1930); U.S. Pat. No. 2,224,708 (Sittert, 1940); U.S. Pat. No. 4,932,128 (Dacey, Jr., 1990); U.S. Pat. No. 4,947,672 (Pecora et al., 1990); U.S. Pat. No. 5,070,616 (Chen, 1991); U.S. Pat. No. 5,465,490 (Smith et al., 1995); U.S. Pat. No. 6,745,611 (Lefavour et al., 2004); U.S. Pat. No. 6,928,739 (Jirele et al., 2005); U.S. Pat. No. 6,957,560 (Lefavour et al., 2005); U.S. Pat. No. 7,111,488 (Lefavour et al., 2006); and U.S. Pat. No. 7,165,439 (Lefavour et al., 2007).

BRIEF SUMMARY OF THE INVENTION

The present invention is a rock cutting and trimming device comprising: a C-clamp having a top port and a bottom port; a hydraulic cylinder; a sleeve; a shaft; a top tooth; and a bottom tooth; wherein the hydraulic cylinder is coupled to the shaft; wherein the shaft fits inside of the sleeve; wherein the sleeve is coupled to the top port of the C-clamp; wherein the top tooth is coupled to the shaft; wherein the bottom tooth is coupled to the bottom port of the C-clamp; wherein each of the top tooth and bottom tooth comprises a cutting edge; wherein the cutting edge of the top tooth faces the cutting edge of the bottom tooth; wherein the hydraulic cylinder causes the top tooth to move vertically upward and downward; and wherein the cutting edges of the top and bottom teeth are vertically aligned so that when the top tooth is fully extended downward, the cutting edge of the top tooth is parallel to the cutting edge of the bottom tooth.

In a preferred embodiment, the present invention further comprises an alignment pin and a locking nut; wherein the shaft comprises a vertical channel; wherein the sleeve comprises a first aperture and a second aperture that are horizontally aligned with one another; wherein the alignment pin is inserted through the first aperture in the sleeve, through the vertical channel in the shaft, and through the second aperture in the sleeve; wherein after the alignment pin is inserted, the locking nut is positioned on the sleeve directly over the first and second apertures, thereby preventing the alignment pin from becoming dislodged; and wherein the alignment pin prevents the shaft from rotating horizontally but allows it to move vertically.

In a preferred embodiment, the hydraulic cylinder has a throw; the vertical channel in the shaft has a length; and the length of the vertical channel is roughly equal to the throw of the hydraulic cylinder. Preferably, the locking nut is positioned directly above the top port of the C-clamp.

In a preferred embodiment, the sleeve comprises a threaded bottom part, and the threaded bottom part of the sleeve screws into the top port of the C-clamp. Preferably, the sleeve comprises a threaded top part; the hydraulic cylinder comprises a threaded bottom part; and the threaded bottom part of the hydraulic cylinder screws into the top part of the sleeve.

In a preferred embodiment, the sleeve comprises a threaded inner portion and an inner chamber; the threaded inner portion of the sleeve is on top of the inner chamber; the hydraulic cylinder screws into the threaded inner portion of the sleeve; the threaded inner portion of the sleeve has a diameter; the inner chamber of the sleeve has a diameter; the hydraulic cylinder has an outer diameter; and the diameter of the threaded inner portion of the sleeve is roughly equal to the outer diameter of the hydraulic cylinder and greater than the diameter of the inner chamber of the sleeve.

In a preferred embodiment, the present invention further comprises a dust seal; the sleeve comprises a bottom end; the dust seal is positioned inside of the bottom end of the sleeve; and the dust seal prevents dust from entering the sleeve when a rock is being cut or trimmed. Preferably, the dust seal is comprised of polyurethane.

In a preferred embodiment, the present invention further comprises at least one wear ring; the sleeve comprises at least one internal recess; the wear ring is situated inside the internal recess in the sleeve; and the wear ring reduces friction between the sleeve and the shaft. Preferably, the wear ring is comprised of a hard nylon material.

In a preferred embodiment, the top tooth can be disengaged from the shaft without removal of the shaft, sleeve or hydraulic cylinder. Preferably, the top and bottom teeth come in different sizes.

In an alternative embodiment, the hydraulic cylinder and shaft are a single part. In yet another alternate embodiment, the C-clamp and sleeve are a single part.

In a preferred embodiment, the shaft has a length, and the length of the shaft is sized so as to provide a desired amount of clearance between the cutting edges of the top and bottom teeth when the hydraulic cylinder is fully extended.

REFERENCE NUMBERS

Figure 1:
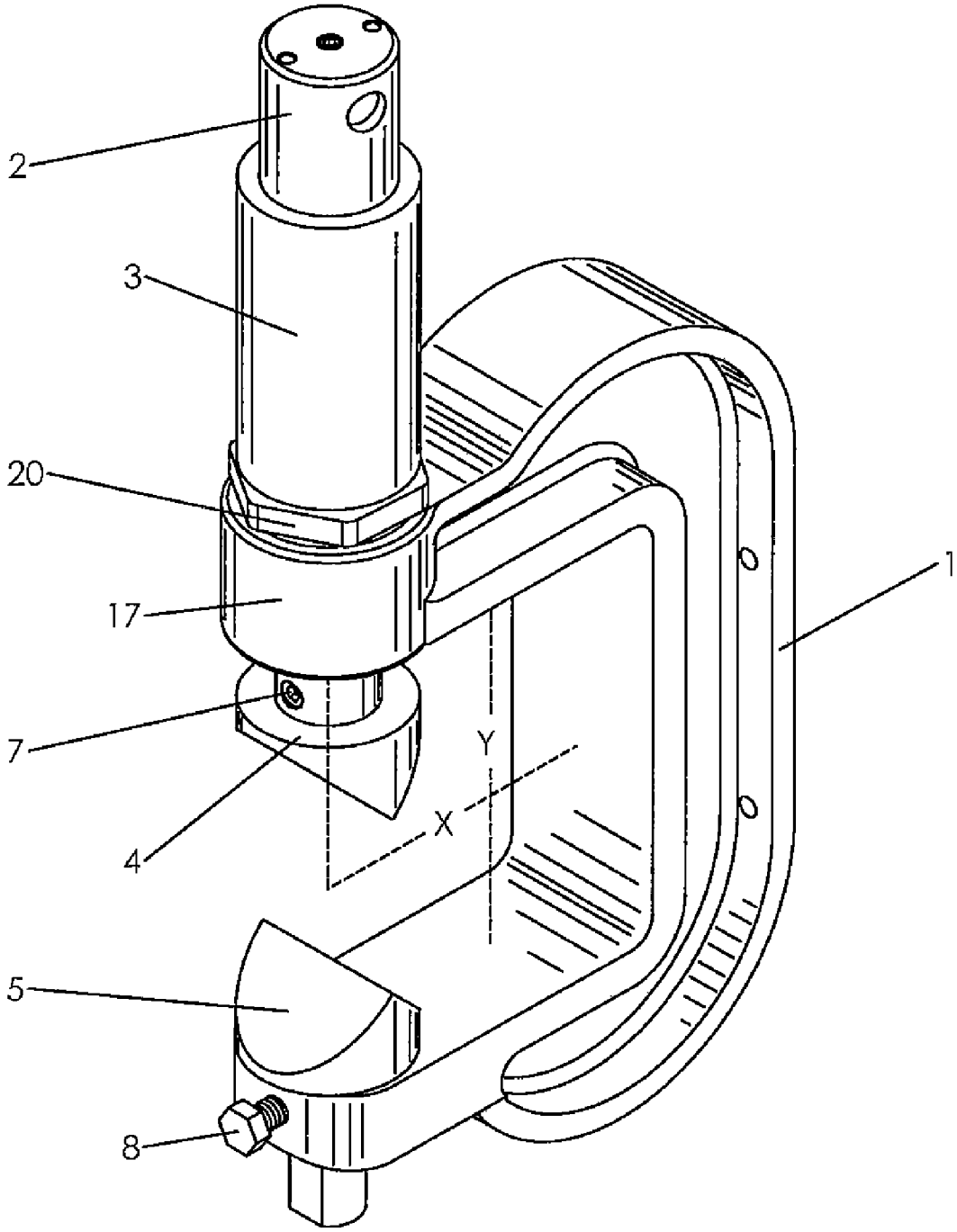
FIG. 1 is a perspective view of a preferred embodiment of the present invention.

1 C-clamp
2 Hydraulic cylinder
3 Sleeve
4 Top tooth
5 Bottom tooth
6 Shaft
7 Bolt (top tooth)
8 Bolt (bottom tooth)
9 Threaded bottom part (of hydraulic cylinder)
10 Threaded top part (of shaft)
11 Channel (in shaft)
12 Alignment pin
13 Aperture (in shaft)
14 First aperture (in threaded bottom part of sleeve)
15 Threaded bottom part (of sleeve)
16 Second aperture (in threaded bottom part of sleeve)
17 First port (of C-clamp)
18 Dust seal
19 Wear ring
20 Locking nut
21 Threaded inner portion (of sleeve)
22 Inner chamber (of sleeve)
23 Lip (of sleeve)
24 Recess (of sleeve)
25 Extension (of top tooth)
26 Aperture (in extension of top tooth)
27 Cutting edge (of top tooth)
28 Extension (of bottom tooth)
29 Cutting edge (of bottom tooth)

DETAILED DESCRIPTION OF INVENTION

FIG. 1 is a perspective view of a preferred embodiment of the present invention. As shown in this figure, the present invention comprises a C-clamp 1, a hydraulic cylinder 2, a sleeve 3, a top tooth 4, and a bottom tooth 5. The present invention further comprises a shaft 6 (see FIG. 2) into which the top tooth 4 is inserted and secured with a bolt 7. The bottom tooth is also secured to the C-clamp with a bolt 8. The present invention further comprises a locking nut 20, the purpose of which will be described in connection with FIG. 3.

In a preferred embodiment, the C-clamp 1 is Press Model Number A-210 manufactured by Enerpac Corp. of Milwaukee, Wis. This C-clamp has a six-inch throat (measured from the back of the C-clamp to the center of the first port 17 through which the shaft 6 extends; see "X" on FIG. 1) and nine inches of vertical daylight (measured from the top of the inside of the C-clamp to the bottom of the inside of the C-clamp; see "Y" on FIG. 1). This particular embodiment of the present invention is designed to withstand ten tons of cutting pressure (i.e., the hydraulic cylinder 2 exerts ten tons of pressure).

In yet another preferred embodiment, the C-clamp 1 is Press Model Number A-220 manufactured by Enerpac Corp. of Milwaukee, Wis. This C-clamp also has a six-inch throat, but it has 11.88 inches of vertical daylight. This particular embodiment of the present invention is designed to withstand 25 tons of cutting pressure (i.e., the hydraulic cylinder 2 exerts 25 tons of pressure).

Although the two ENERPAC® C-clamps mentioned above are preferred embodiments, the present invention is not limited to any particular make or model of C-clamp, as long as a C-clamp is used. As will be shown in connection with FIG. 13, the open C-clamp design is what allows the present invention to cut corner pieces more effectively than prior art table-top-type cutters.

Figure 2:
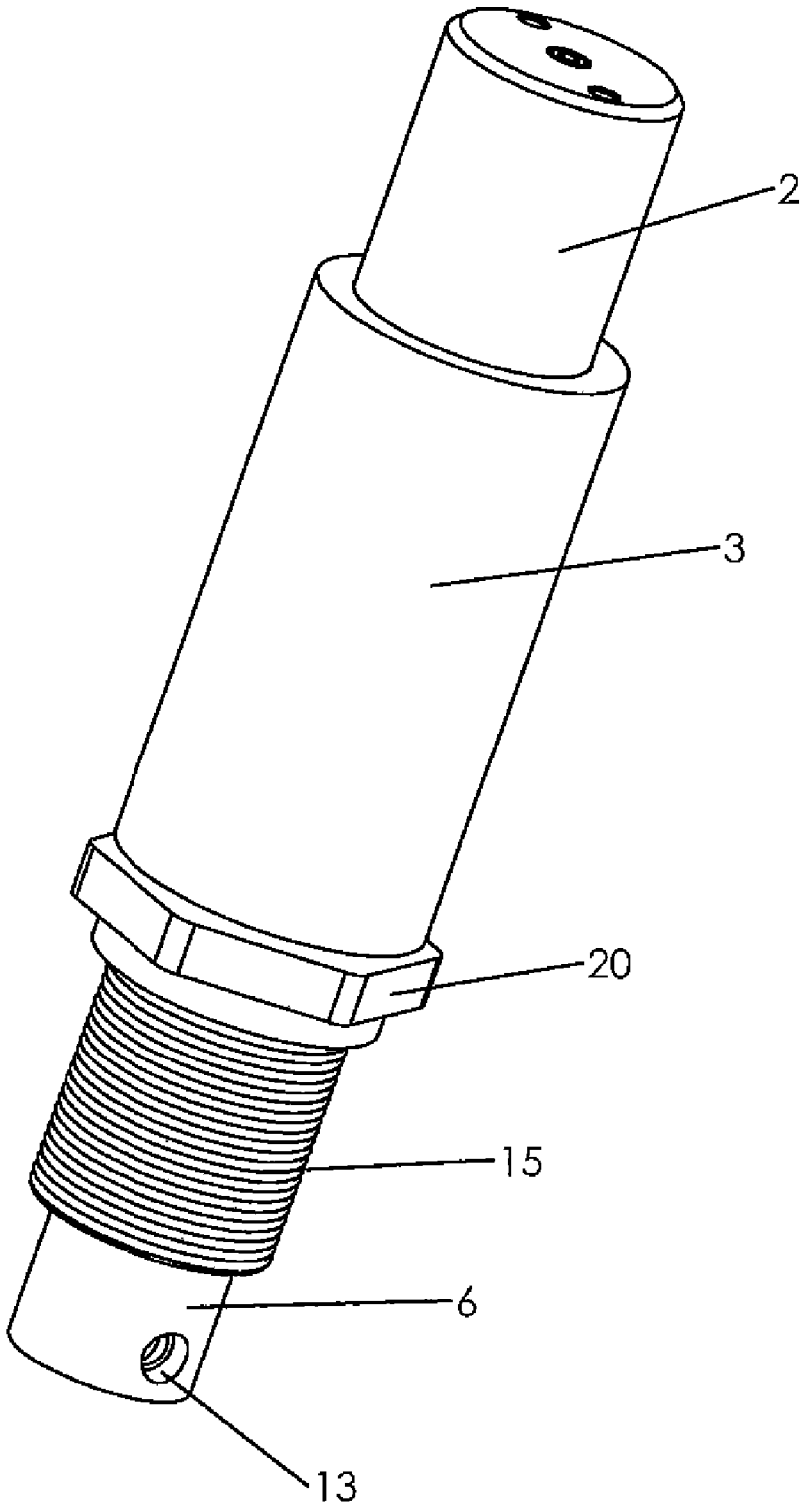
FIG. 2 is a perspective view of the hydraulic cylinder, sleeve and shaft of the present invention.
Figure 3:
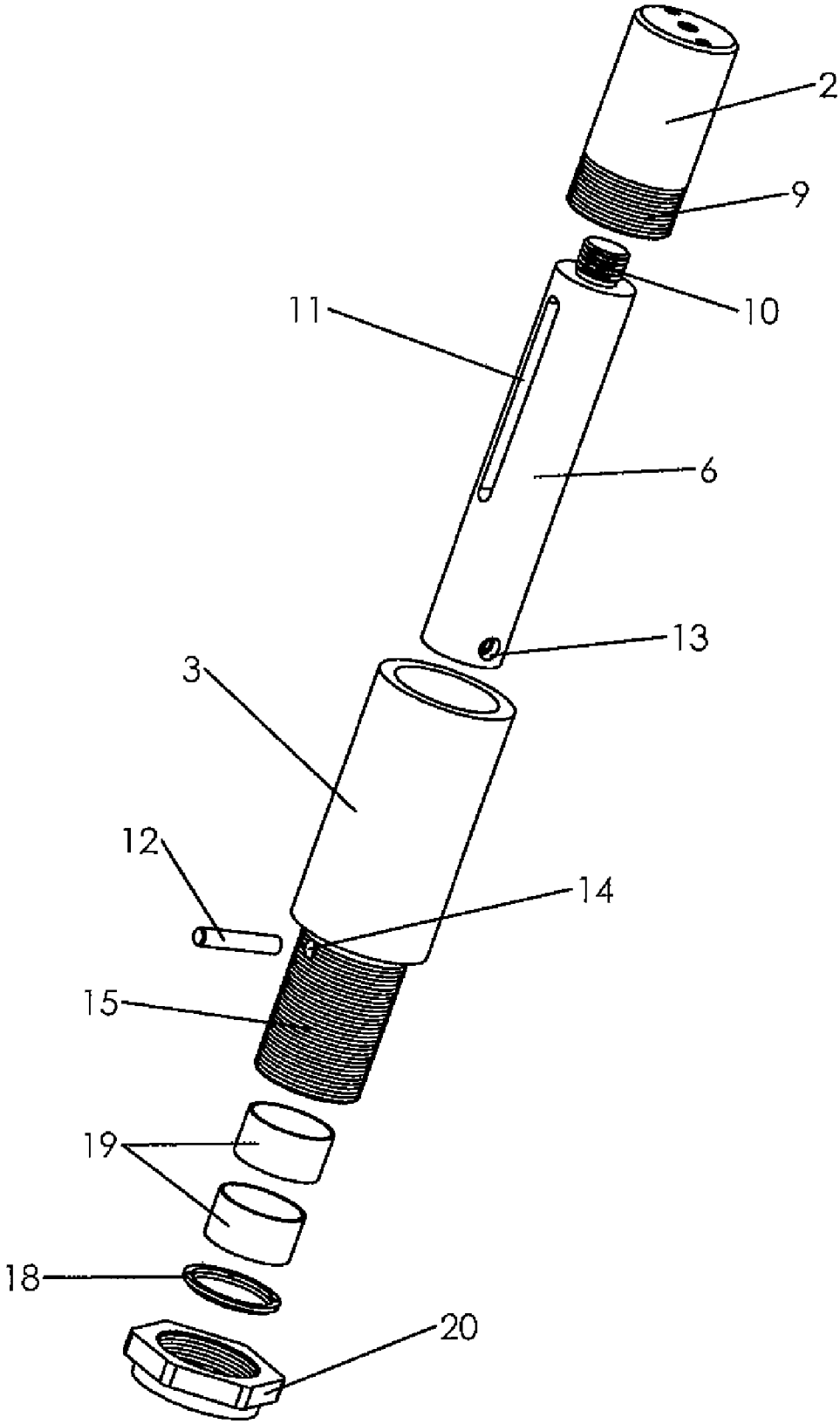
FIG. 3 is an exploded view of the hydraulic cylinder, sleeve and shaft of the present invention.

FIG. 2 is a perspective view and FIG. 3 is an exploded view of the hydraulic cylinder 2, sleeve 3 and shaft 6 of the present invention. As shown in these two figures, the hydraulic cylinder 2 comprises a threaded bottom part 9 that screws into the top of the sleeve 3, which also comprises an threaded inner portion 21 (see FIG. 4). In this embodiment, the shaft 6 comprises a threaded top part 10 that screws into the bottom of the hydraulic cylinder 2. The shaft 6 further comprises a channel 11 through which the alignment pin 12 extends when the invention is fully assembled. The shaft 6 further comprises an aperture 13 for the bolt 7 that anchors the top tooth 4 (not shown) to the shaft 6.

When the invention is fully assembled, the hydraulic cylinder 2 is screwed into the top of the sleeve 3, and the shaft 6 is inserted into the sleeve and screwed into the bottom of the hydraulic cylinder 2. The alignment pin 12 is inserted into a first aperture 14 in the threaded bottom part 15 of the sleeve 3, through the channel 11 in the shaft 6, and into a second aperture 16 (not shown) exactly opposite the first aperture 14 on the threaded bottom part 15 of the sleeve 3. The length of the alignment pin 12 is such that it does not extend beyond the threaded bottom part 15 of the sleeve 3 when fully inserted. The function of the alignment pin 12 is to maintain the shaft 6 in a secure position so that it does not rotate horizontally but can still move vertically. The length of the channel 11 in the shaft 6 is preferably roughly equal to the throw of the hydraulic cylinder. In this context, the "throw" of the hydraulic cylinder is the distance between the position of the hydraulic cylinder in a fully retracted position and the position of the hydraulic cylinder in a fully extended position.

Once the alignment pin 12 is installed as described above, the locking nut 8 is positioned around the threaded bottom part 15 of the sleeve 3 directly over the first and second apertures 14, 16 (as shown in FIG. 2) to prevent the alignment pin 12 from dislodging. When the invention is fully assembled (as shown in FIG. 1), the locking nut 8 is positioned directly above the first port 17 (also referred to as the "top port"), and the threaded bottom part 15 of the sleeve 3 is screwed into the first port 17 of the C-clamp 1.

In a preferred embodiment, the present invention further comprises a dust seal 18 and two wear rings 19. The position of the dust seal 18 and wear rings 19 will be shown more clearly in connection with FIGS. 4, 5 and 6. The function of the dust seal 18 is to prevent dust from entering the sleeve 3 and/or shaft 6 when the invention is being used to cut rock. Preferably, the inside diameter of the wear rings is 0.01 less than the inside diameter of the sleeve 3 and is equal to the outside diameter of the shaft 6. The function of the wear rings 19 is to reduce the metal-on-metal wear that would be caused by the shaft 6 wearing against the inside of the sleeve 3. The wear rings 19 also reduce the amount of precise machining required because it is no longer necessary to ream and hone the inside of the sleeve 3 to create a smooth finish. The dust seal is preferably made of polyurethane, and the wear rings are preferably made of a hard nylon material.

Figure 4:
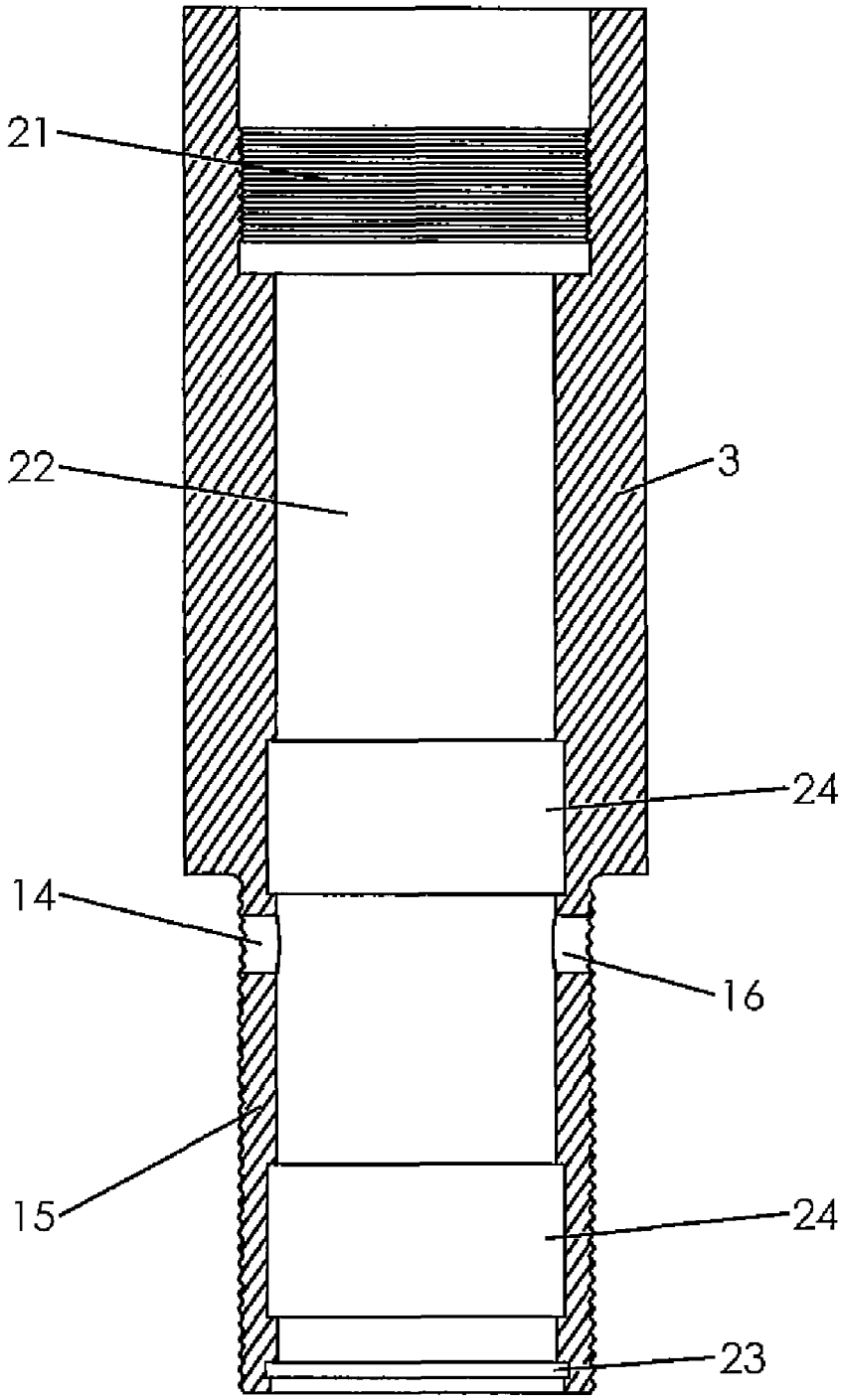
FIG. 4 is a section view of the sleeve of the present invention.

FIG. 4 is a section view of the sleeve 3 of the present invention. As shown in this figure, the sleeve 3 comprises a threaded inner portion 21, into which the threaded bottom part 9 of the hydraulic cylinder 2 (not shown) is screwed. The diameter of the threaded inner portion 21 of the sleeve 3 is roughly equal to the outer diameter of the hydraulic cylinder 2 and is also preferably greater than the diameter of the inner chamber 22 of the sleeve 3 so as to prevent the hydraulic cylinder 2 from moving further downward inside of the sleeve 3.

The dust seal 18 (not shown) is preferably positioned just inside of the bottom end of the sleeve 3, which preferably comprises a lip 23 into which the dust seal 18 fits. The inner chamber 22 of the sleeve 3 preferably comprises two recesses 24 into which the wear rings 19 (not shown) fit. When the shaft is inserted into the sleeve 3 and attached to the hydraulic cylinder 2, it will move up and down inside of the sleeve 3 concurrently with the movement of the hydraulic cylinder 2. Because the dust seal 18 and wear rings 19 are fixedly attached to the sleeve 3, the shaft 6 will move up and down inside of the dust seal 18 and wear rings 19 as well.

Figure 5:
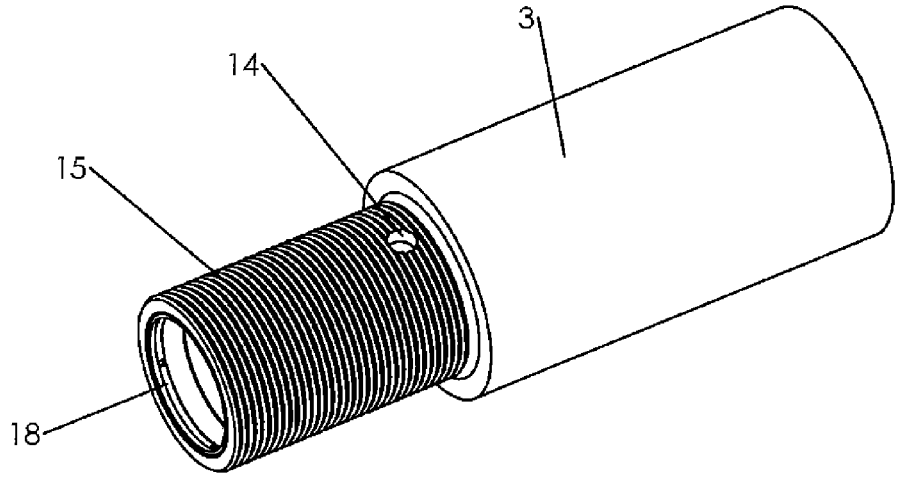
FIG. 5 is a perspective view of the sleeve of the present invention.
Figure 6:
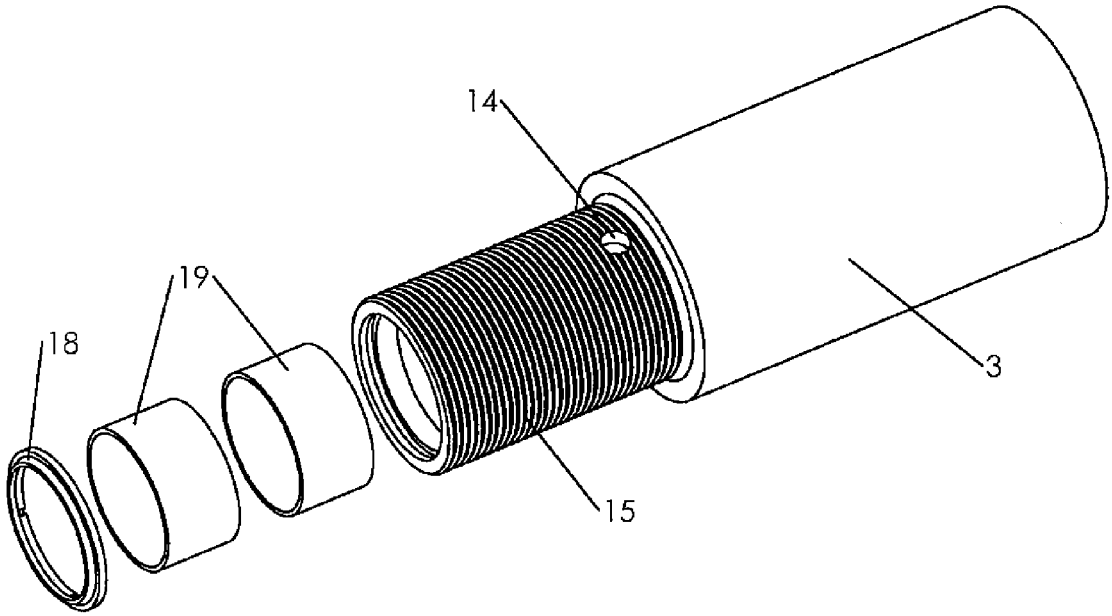
FIG. 6 is an exploded view of the sleeve of the present invention.

FIG. 5 is a perspective view and FIG. 6 is an exploded view of the sleeve 3 of the present invention. As shown in these two figures, the dust seal 18 is positioned just inside of the bottom end of the threaded bottom part 15 of the sleeve 3. The wear rings 19 are inserted inside of the sleeve 3, in roughly the positions indicated in FIG. 4.

Figure 7:
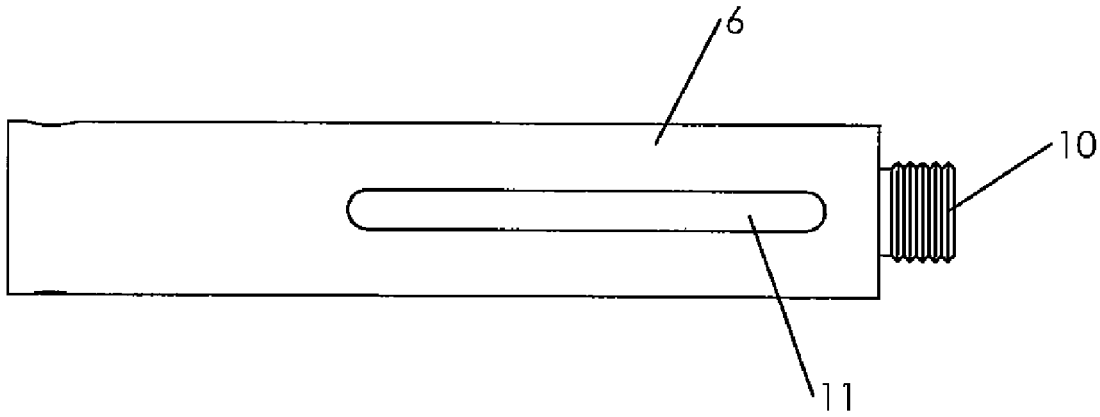
FIG. 7 is a side view of the shaft of the present invention.
Figure 8:
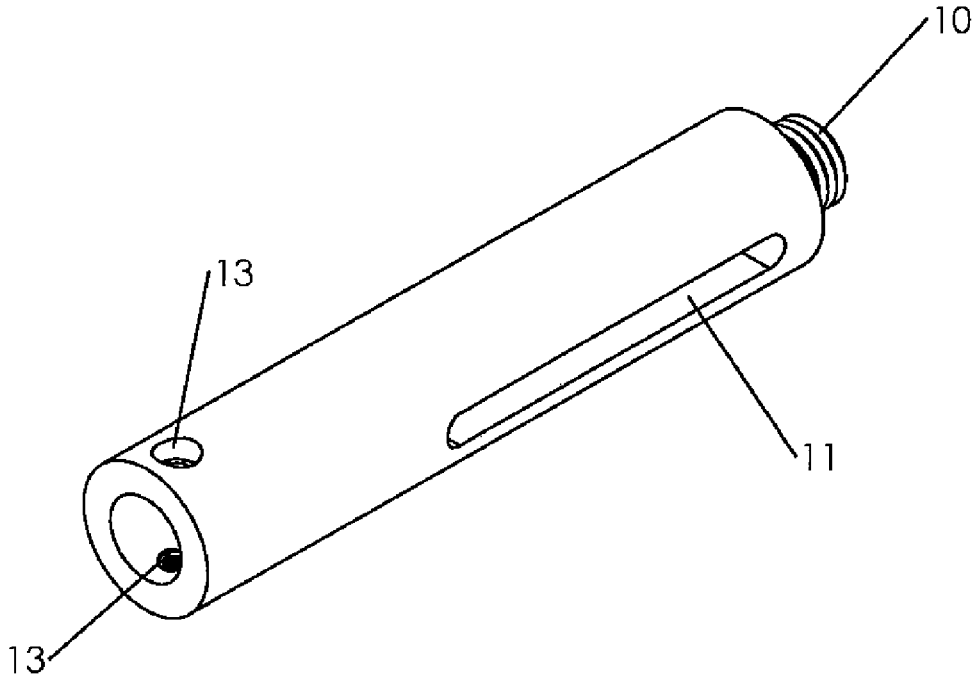
FIG. 8 is a perspective view of the shaft of the present invention.

FIG. 7 is a side view and FIG. 8 is a perspective view of the shaft 6 of the present invention. These two figures show the channel 11 through which the alignment pin 12 (not shown) extends, the threaded top part 10 that screws into the bottom of the hydraulic cylinder 2, and the aperture 13 on each side of the shaft 6 through which the bolt 7 that secures the top tooth 4 in place extends.

Figure 9:
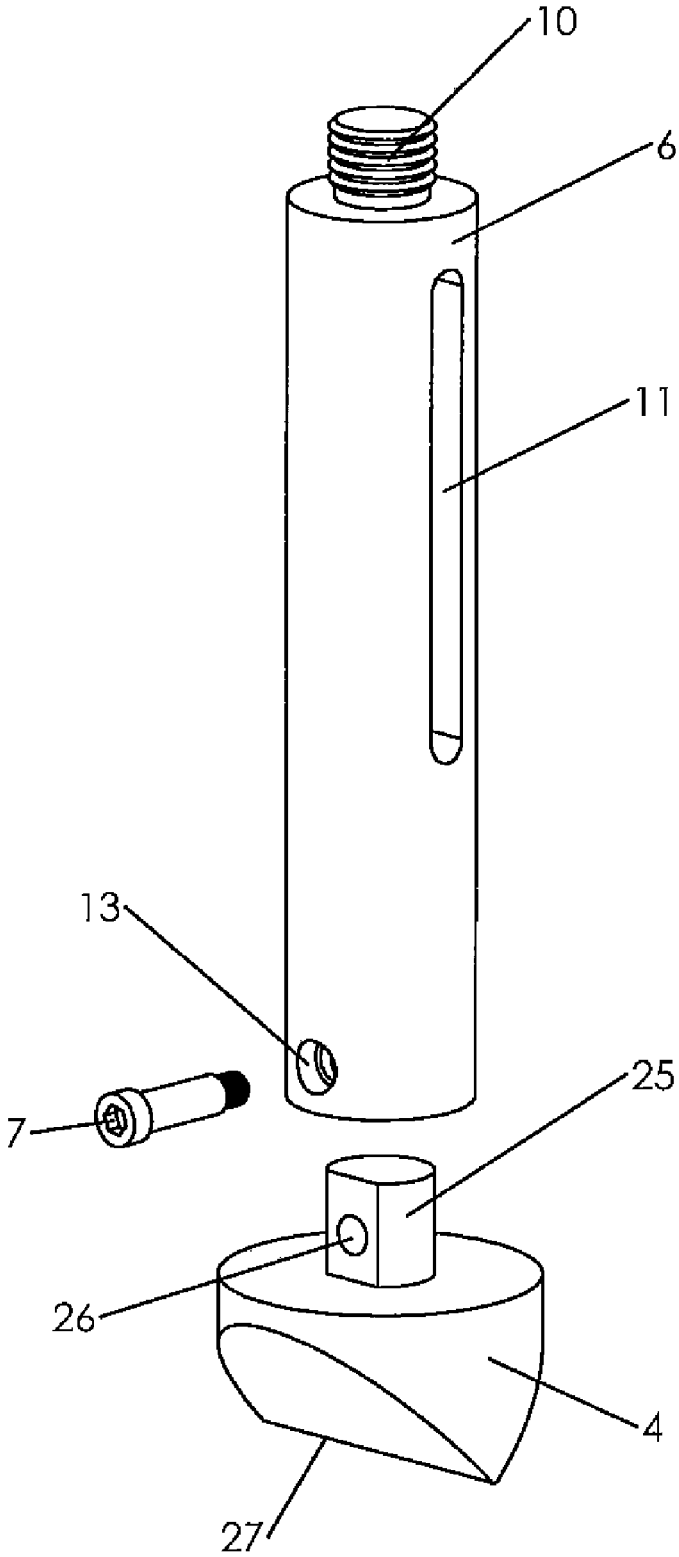
FIG. 9 is an exploded view of the shaft and top tooth of the present invention.

FIG. 9 is an exploded view of the shaft 6 and top tooth 4 of the present invention. As shown in this figure, the top tooth 4 comprises an extension 25 that fits up into the bottom end of the shaft 6. The extension 25 comprises an aperture 26 through which the bolt is inserted 7 after passing through the aperture 13 in the bottom end of the shaft 6, thereby securing the top tooth 4 to the shaft 6. Although the top tooth 4 may be secured to the shaft with a bolt 7, as shown in this figure, other mechanisms for securing the top tooth 4 to the shaft 6 (such as a set screw) may be utilized as well.

The top tooth 4 further comprises a cutting edge 27, which will come into contact with the rock during operation of the invention. Because the top tooth 4 is fixedly attached to the shaft 6 and the shaft 6 is fixedly attached to the hydraulic cylinder 2, the top tooth 4 will move up and down concurrently with the hydraulic cylinder 2 and shaft 6.

Figure 10:
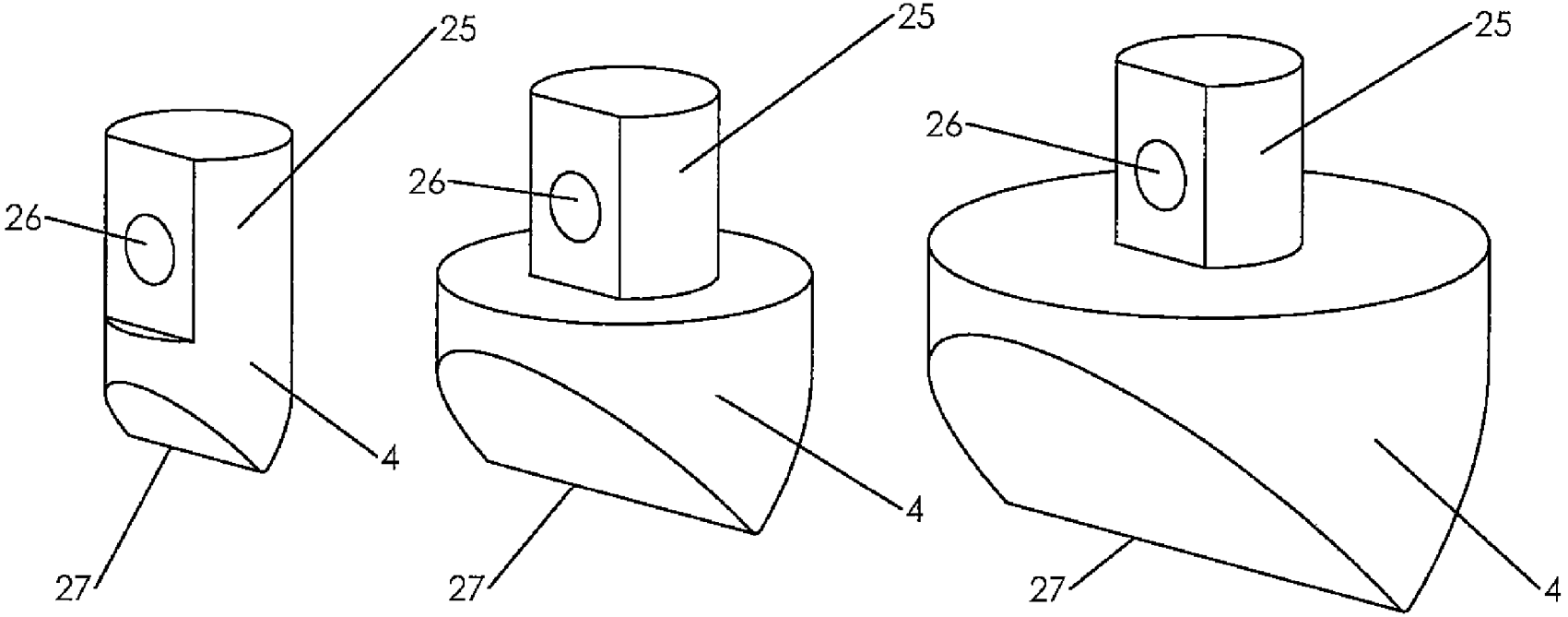
FIG. 10 is a perspective view of three different embodiments of the top tooth of the present invention.

FIG. 10 is a perspective view of three different embodiments of the top tooth 4 of the present invention. As shown in FIG. 1, the top tooth 4 can be removed by simply unscrewing the bolt 7 (or set screw) and pulling the top tooth out of the bottom end of the shaft 6. In this manner, different sizes of the top tooth 4 may be utilized. FIG. 10 shows three different sizes of the top tooth 4. The diameter of the top extension 25 must remain constant to fit inside of the bottom end of the shaft 6, but the length of the cutting edge 27 may vary to accommodate different cutting requirements.

Figure 11:
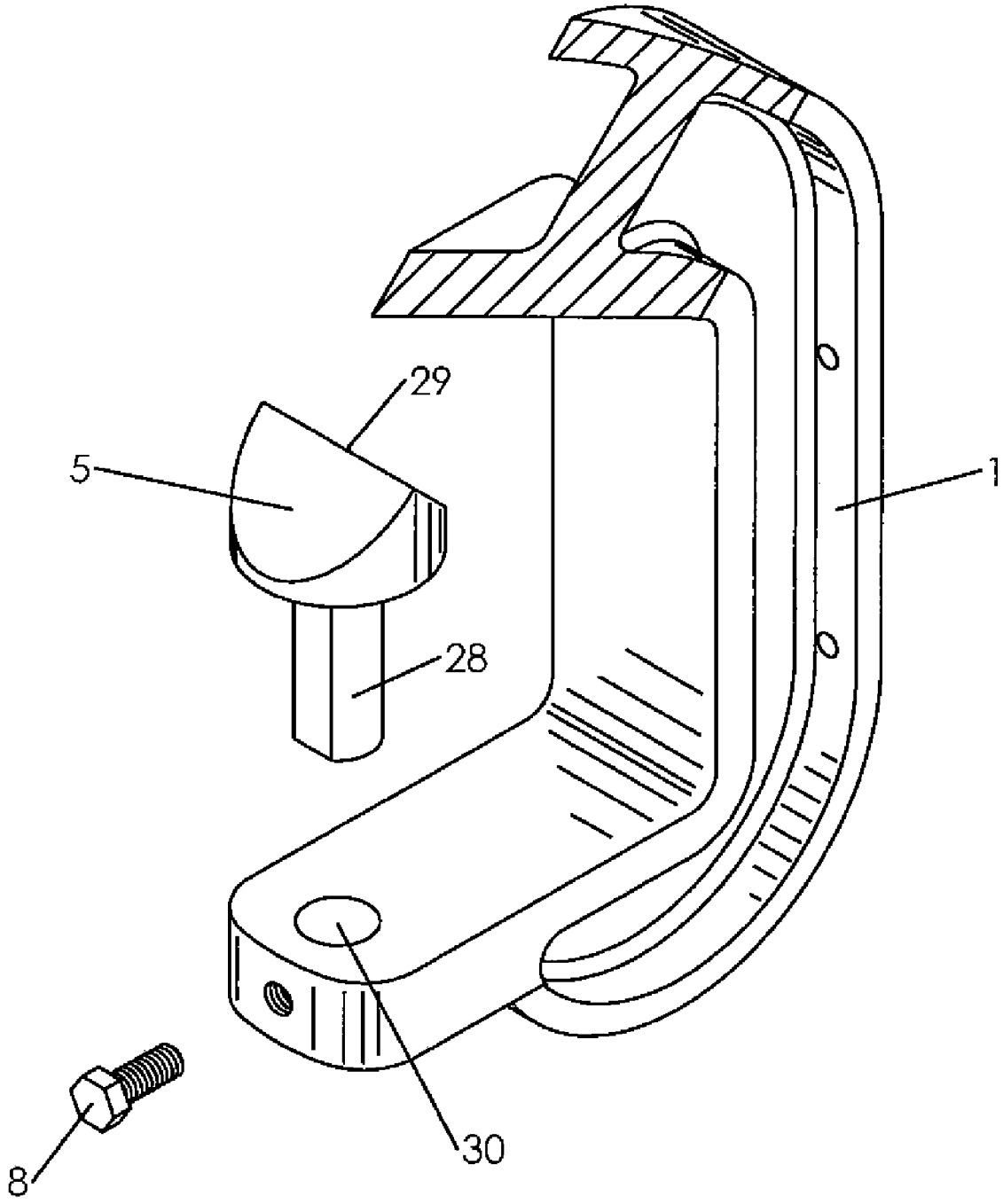
FIG. 11 is an exploded view of the bottom tooth in relation to the bottom part of the C-clamp of the present invention.

FIG. 11 is an exploded view of the bottom tooth in relation to the bottom part of the C-clamp of the present invention. The bottom tooth 5 comprises an extension 28 that fits into the second port 30 (also referred to as the "bottom port") in the C-clamp 1. A bolt 8 acts as a set screw and secures the bottom tooth 5 to the C-clamp 1. The present invention is not limited to any particular manner of securing the bottom tooth 5 to the C-clamp 1, however. The bottom tooth further comprises a cutting edge 29. As with the top tooth 4, the bottom tooth 5 may come in different sizes (i.e., cutting edges of different lengths), as long as the diameter of the extension 28 remains the same. To replace the bottom tooth 5, the bolt 8 is simply loosened and removed.

Figure 12:
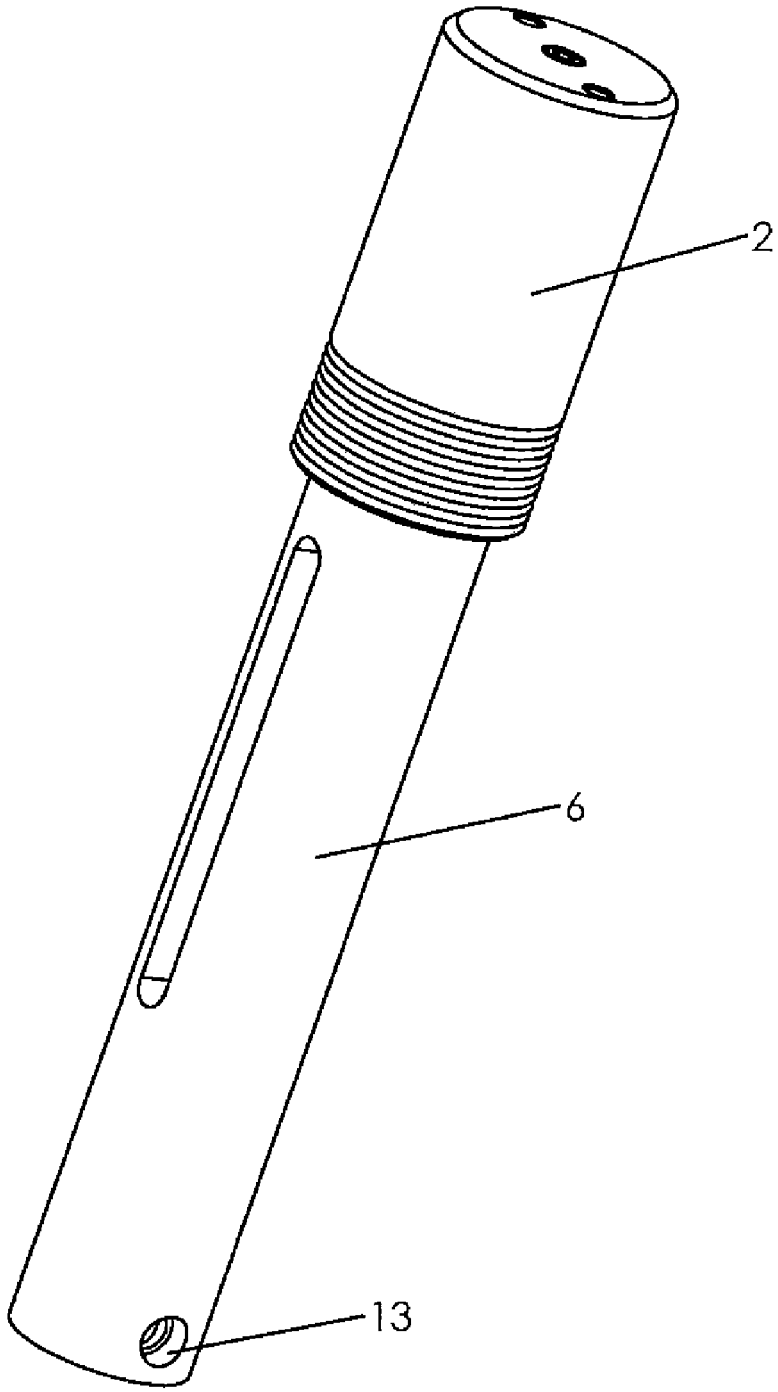
FIG. 12 is a perspective view of an alternate embodiment of the hydraulic cylinder and shaft in which the hydraulic cylinder and shaft are a single part.

FIG. 12 is a perspective view of an alternate embodiment of the hydraulic cylinder 2 and shaft 6 in which the hydraulic cylinder and shaft are a single part. In this embodiment, rather than having the shaft 6 screw into the bottom end of the hydraulic cylinder 2, the shaft 6 and hydraulic cylinder 2 are manufactured as a single part. All other aspects of the invention are the same.

Figure 13:
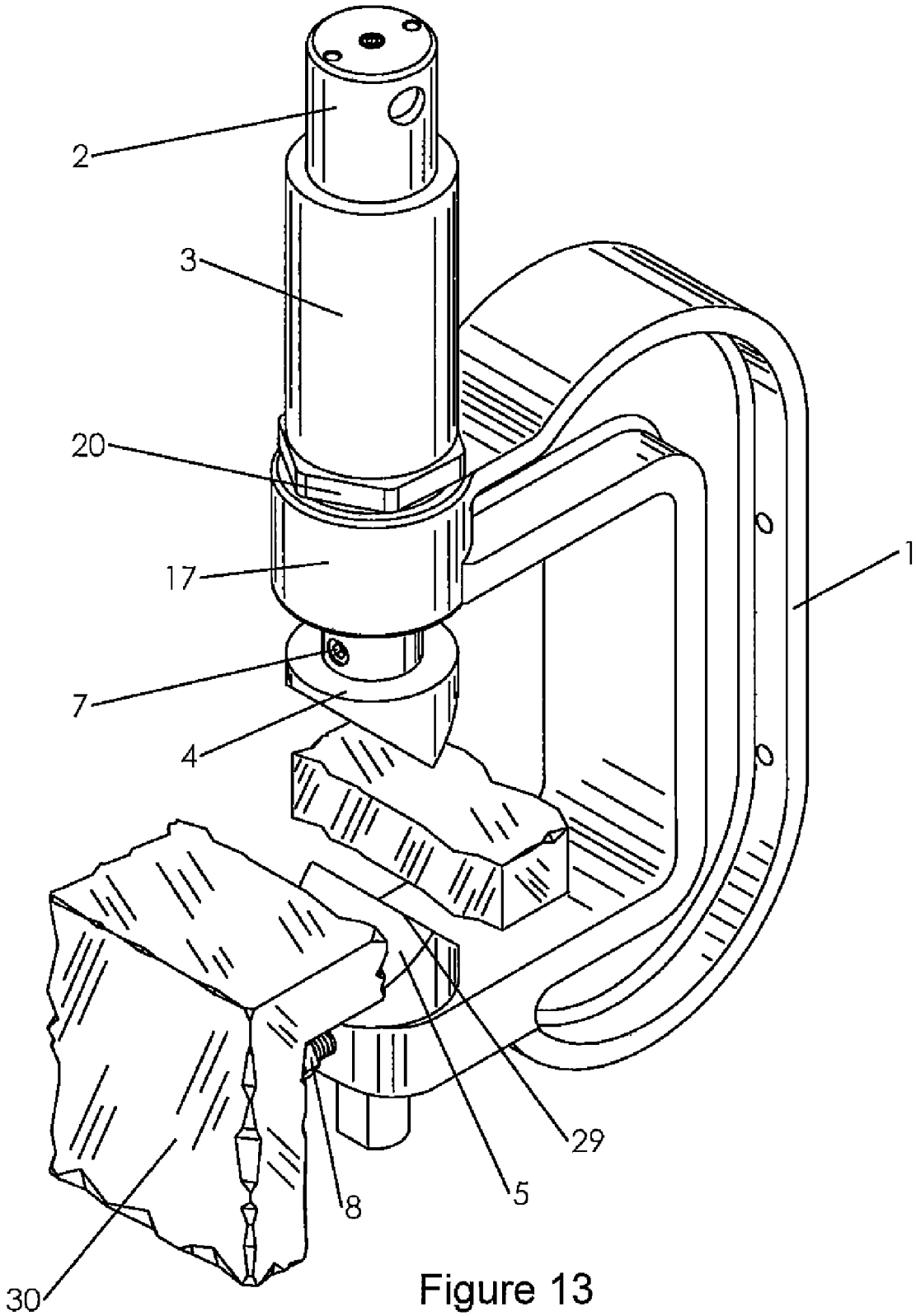
FIG. 13 is a perspective view of the present invention shown in relation to a piece of rock that has been cut.

FIG. 13 is a perspective view of the present invention shown in relation to a piece of rock that has been cut. When the hydraulic cylinder 2 is activated, the top tooth 4 extends downward to meet the bottom tooth 5, thereby shearing the rock that is placed between the top and bottom teeth. The length of the shaft 6 is preferably sized so as to provide the desired amount of clearance between the top and bottom teeth when the hydraulic cylinder is fully extended. As shown in this figure, given the open C-clamp design of the present invention, corner pieces can be cut or trimmed with ease because there is no tabletop preventing the rock piece from extending beneath the shearing surface (i.e., the cutting edge 29 of the bottom tooth 5). This allows for the rock to be positioned in a manner that will provide a more precise cut.

The hydraulic cylinder 2 can be driven by an air or electric hydraulic pump, which can be operated by foot (pedal) or hand (lever). The present invention is not limited to any particular type of hydraulic pump or method of operating the hydraulic pump.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A rock cutting and trimming device comprising:

(a) a C-clamp having a top port and a bottom port;

(b) a hydraulic cylinder;

(c) a sleeve;

(d) a shaft;

(e) a top tooth;

(f) a bottom tooth; and (g) an alignment pin and a locking nut;

wherein the hydraulic cylinder is coupled to the shaft;

wherein the shaft fits inside of the sleeve;

wherein the sleeve is coupled to the top port of the C-clamp;

wherein the top tooth is coupled to the shaft;

wherein the bottom tooth is coupled to the bottom port of the C-clamp;

wherein each of the top tooth and bottom tooth comprises a cutting edge;

wherein the cutting edge of the top tooth faces the cutting edge of the bottom tooth;

wherein the hydraulic cylinder causes the top tooth to move vertically upward and downward;

wherein the cutting edges of the top and bottom teeth are vertically aligned so that when the top tooth is fully extended downward, the cutting edge of the top tooth is parallel to the cutting edge of the bottom tooth;

wherein the shaft comprises a vertical channel;

wherein the sleeve comprises a first aperture and a second aperture that are horizontally aligned with one another;

wherein the alignment pin is inserted through the first aperture in the sleeve, through the vertical channel in the shaft, and through the second aperture in the sleeve;

wherein after the alignment pin is inserted, the locking nut is positioned on the sleeve directly over the first and second apertures, thereby preventing the alignment pin from becoming dislodged; and wherein the alignment pin prevents the shaft from rotating horizontally but allows it to move vertically.

2. The rock cutting and trimming device of claim 1, wherein the hydraulic cylinder has a throw;

wherein the vertical channel in the shaft has a length; and wherein the length of the vertical channel is roughly equal to the throw of the hydraulic cylinder.

3. The rock cutting and trimming device of claim 1, wherein the locking nut is positioned directly above the top port of the C-clamp.

4. A rock cutting and trimming device comprising:

(a) a C-clamp having a top port and a bottom port;

(b) a hydraulic cylinder;

(c) a sleeve;

(d) a shaft;

(e) a top tooth; and (f) a bottom tooth;

wherein the hydraulic cylinder is coupled to the shaft;

wherein the shaft fits inside of the sleeve;

wherein the sleeve is coupled to the top port of the C-clamp;

wherein the top tooth is coupled to the shaft;

wherein the bottom tooth is coupled to the bottom port of the C-clamp;

wherein each of the top tooth and bottom tooth comprises a cutting edge;

wherein the cutting edge of the top tooth faces the cutting edge of the bottom tooth;

wherein the hydraulic cylinder causes the top tooth to move vertically upward and downward;

wherein the cutting edges of the top and bottom teeth are vertically aligned so that when the top tooth is fully extended downward, the cutting edge of the top tooth is parallel to the cutting edge of the bottom tooth;

wherein the sleeve comprises a threaded top part;

wherein the hydraulic cylinder comprises a threaded bottom part;

wherein the threaded bottom part of the hydraulic cylinder screws into the top part of the sleeve;

wherein the sleeve comprises a threaded inner portion and an inner chamber;

wherein the threaded inner portion of the sleeve is on top of the inner chamber;

wherein the hydraulic cylinder screws into the threaded inner portion of the sleeve;

wherein the threaded inner portion of the sleeve has a diameter;

wherein the inner chamber of the sleeve has a diameter;

wherein the hydraulic cylinder has an outer diameter; and wherein the diameter of the threaded inner portion of the sleeve is roughly equal to the outer diameter of the hydraulic cylinder and greater than the diameter of the inner chamber of the sleeve.

5. A rock cutting and trimming device comprising:

(a) a C-clamp having a top port and a bottom port;

(b) a hydraulic cylinder;

(c) a sleeve;

(d) a shaft;

(e) a top tooth;

(f) a bottom tooth; and (g) at least one wear ring;

wherein the hydraulic cylinder is coupled to the shaft;

wherein the shaft fits inside of the sleeve;

wherein the sleeve is coupled to the top port of the C-clamp;

wherein the top tooth is coupled to the shaft;

wherein the bottom tooth is coupled to the bottom port of the C-clamp;

wherein each of the top tooth and bottom tooth comprises a cutting edge;

wherein the cutting edge of the top tooth faces the cutting edge of the bottom tooth;

wherein the hydraulic cylinder causes the top tooth to move vertically upward and downward;

wherein the cutting edges of the top and bottom teeth are vertically aligned so that when the top tooth is fully extended downward, the cutting edge of the top tooth is parallel to the cutting edge of the bottom tooth;

wherein the sleeve comprises at least one internal recess;

wherein the wear ring is situated inside the internal recess in the sleeve; and wherein the wear ring reduces friction between the sleeve and the shaft.

6. The rock cutting and trimming device of claim 5, wherein the wear ring is comprised of a hard nylon material.

* * * * *